United States Patent [19]

Knotter et al.

[11] Patent Number: 4,527,579

[45] Date of Patent: Jul. 9, 1985

[54] CANE

[75] Inventors: David G. Knotter, 4634 N. 44th St., Phoenix, Ariz. 85018; Jody L. Numbers, Scottsdale, Ariz.

[73] Assignee: David G. Knotter, Phoenix, Ariz.

[21] Appl. No.: 472,968

[22] Filed: Mar. 7, 1983

[51] Int. Cl.[3] ..... A45B 9/00; F16C 11/10

[52] U.S. Cl. ..... 135/74; 403/100

[58] Field of Search ..... 135/74, DIG. 9, 109, 135/112, 25 R, 25 A, 26; 16/388, 389, 387, 327, 352, 364, 365; 403/100, 102, 101

[56] References Cited

U.S. PATENT DOCUMENTS

| | | | |
|---|---|---|---|
| 663,857 | 12/1900 | Browder | 403/100 |
| 738,554 | 9/1903 | Lingel | 135/74 |
| 911,636 | 2/1909 | Whitlock | 403/102 X |
| 2,029,484 | 2/1936 | Howard et al. | 403/100 |

FOREIGN PATENT DOCUMENTS

| | | | |
|---|---|---|---|
| 639513 | 12/1936 | Fed. Rep. of Germany | 403/102 |
| 1490802 | 11/1977 | United Kingdom | 135/74 |

*Primary Examiner*—Robert E. Bagwill
*Assistant Examiner*—Arnold W. Kramer
*Attorney, Agent, or Firm*—Cahill, Sutton & Thomas

[57] ABSTRACT

A foldable cane constructed in three sections each joined by pairs of hinge links having laterally displaced hinge pins which permit adjoining sections to be swung through 180° relative to each other so that in the folded configuration of the cane the three sections are disposed along side each other in essentially parallel relationship to occupy a minimum amount of space. The pairs of hinge links are equipped with spring urged slidable locking sleeves for locking the hinge links in axial alignment when the cane is in use. The hinge links of each pair further include a cam on one of the links for camming the locking sleeve on the other link out of locking position temporarily when the cane is erected by bringing the sections into alignment with the cam fitting into a cut away portion on the other hinge link for axial alignment of the links and a protuberance on the cam link fitting in a recess in the other link to help prevent lateral displacement or twisting out of axial alignment by external forces when in use.

2 Claims, 4 Drawing Figures

CANE

TECHNICAL FIELD

This invention relates to foldable walking canes which can be rendered compact for storage but which are sturdy and aesthetically appealing when erected for use.

BACKGROUND ART

The walking cane has been with man and woman virtually from man's beginning on earth. Down through the ages canes have taken on countless shapes and forms. The sturdy canes, of so much comfort and assistance to the lame and disabled, can become a bothersome nuisance to the user who is sitting in a restaurant or in a motor vehicle, does not need the cane at that moment and finds no place to conveniently stash it away until it is again needed. Thus, it is not surprising that many proposals have been advanced for canes that can be dismantled or collapsed for more convenient storage.

The collapsible canes of the past often have, like their users, suffered from one or more disabilities. Collapsible canes with insufficient strength have often collapsed when not intended to collapse. Others, when dismantled, or collapsed, have been difficult to reassemble or erect when needed. This latter malady can be frustrating for the elderly user suffering, say, from arthritis, who has difficulty manipulating the cane components with painfully stiffened fingers. And then there have been collapsible canes replete with gadget like features having no aesthetic appeal whatsoever.

What has been needed is a cane which is sturdy and reliable when used for walking, can be quickly and easily converted between its use and storage conditions even by persons lacking manual dexterity and which has at least a modicum of aesthetic appeal.

DISCLOSURE OF THE INVENTION

The foregoing requirements are fully satisfied by the cane of this invention which is constructed in sections—three sections, preferably for a cane to be used by an average person—and the sections are linked by improved hinge means which permit the sections to be folded alongside and parallel each other in a very compact storage condition. The hinge means includes hinge links which are connected by a hinge pin displaced laterally from the axis of the cane sections so that the adjoining sections can be folded back along side each other. One hinge link of each hinge means has a distal portion extending past the hinge pin for meshing with a recessed portion of the other hinge link. A locking sleeve carried by that other hinge link slides over the distal portion of the one hinge link to securely lock the hinge means with the links in alignment when the cane is to be used. A cam surface on the distal portion of the one hinge link urges the locking sleeve out of the way as the hinge links are brought into alignment and a spring urges the sleeve into its locking position when the links are aligned. A further feature of the improved hinge means is a protuberance on one of the hinge links for entering a recess in the other hinge link to stabilize the links against lateral movement when they are aligned.

BEST MODE FOR CARRYING OUT THE INVENTION

Figure 1:
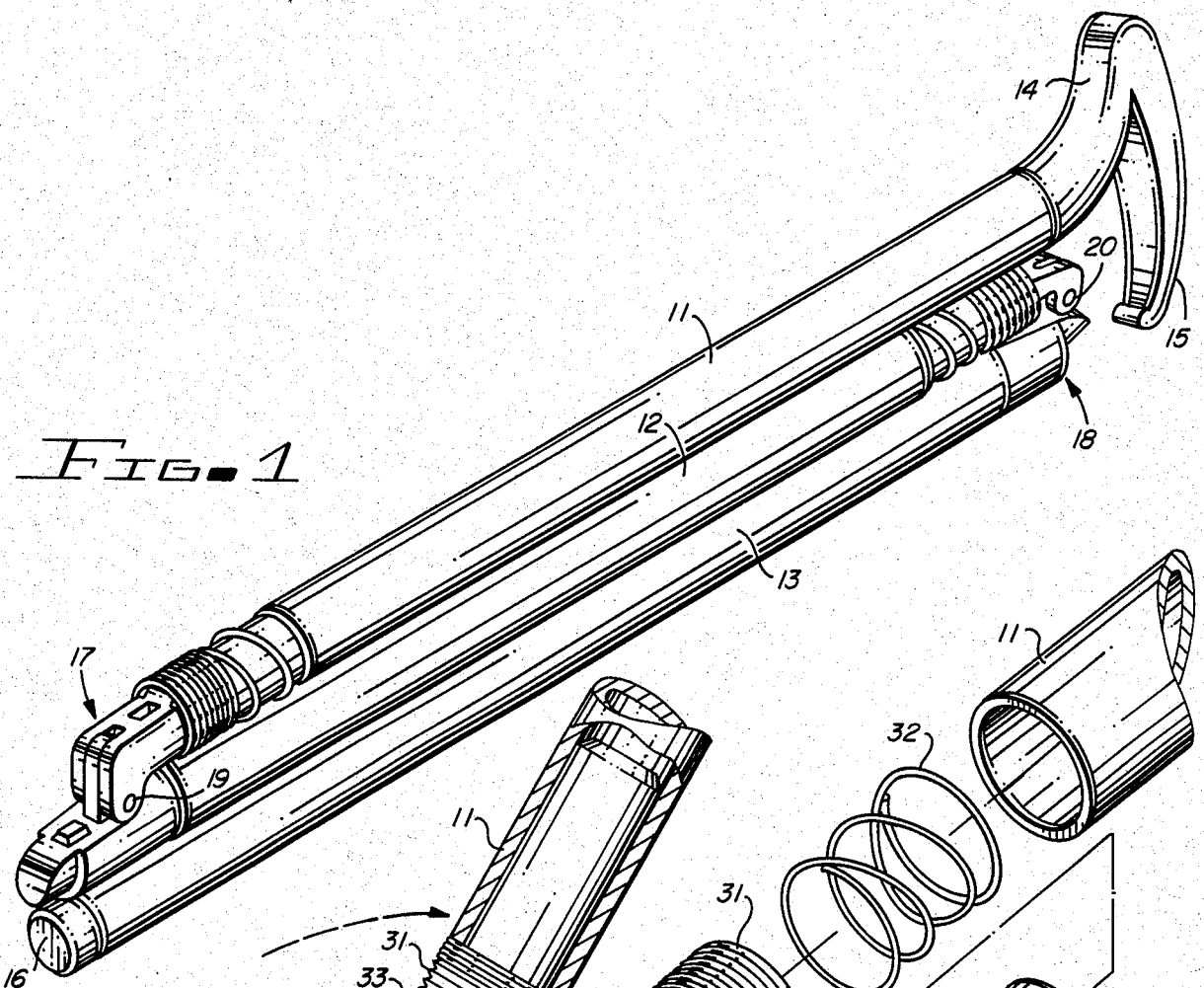
FIG. 1 is a perspective view of a cane embodying this invention.

Referring particularly to FIG. 1, there is illustrated a cane embodying this invention and disposed in its folded, or storage condition. The cane comprises three sections, 11, 12 and 13, providing, respectively, the upper, middle and lower regions of the cane. These sections are preferably made from a lightweight, high strength material such as tubular steel or tubular aluminum. The upper end of section 11 has a handle 14 attached thereto. Handle 14 is preferably provided with a rearwardly extending palm engaging portion 15 which extends in the general vicinity of the upper end of cane lower section 13 when the cane is folded. The lower end of section 13 preferably carries a resilient non-skid tip 16 made of rubber or like material. For convenience of manufacture, upper and middle sections 11 and 12 of the cane are preferably made of the same length of approximately nine inches and the length of the lower section 13 is adjusted to provide the desired overall cane length which will customarily vary between 30 and 38 inches overall.

The upper and middle sections 11 and 12 of the cane are connected by first hinge means indicated generally by reference numeral 17 and the middle and lower sections 12 and 13 are connected by means of hinge means indicated generally by reference numeral 18. Hinge means 17 and 18 are identical except that they are connected to their respective cane sections in such a manner that the hinge pin 19 of the first hinge means 17 is displaced laterally from the longitudinal axis of upper and middle sections 11 and 12 in a manner to permit middle section 12 to be swung around hinge pin 19 through an arc of 180° to lie alongside of and parallel to upper section 11 in the position shown in FIG. 1. Hinge means 18, on the other hand, has its hinge pin 20 displaced laterally from the axis of middle section 12 in a direction opposite the displacement of hinge pin 19 of the first hinge means relative to the axis of middle section 13 so as to permit lower section 13 to be swung through an arc of approximately 180° to a position alongside of and parallel to middle section 12 as illustrated in FIG. 1.

Figure 2:
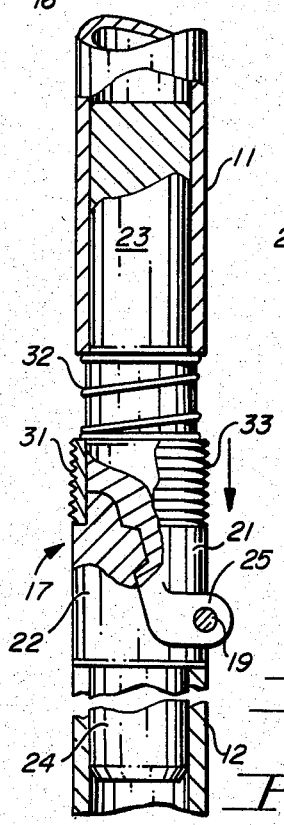
FIG. 2 is an elevational view of hinge means employed in the invention, with portions broken away to enhance the illustration.

When unfolded for use, sections 11, 12 and 13 of the cane are axially aligned as are the components of hinge means 17 and 18. FIG. 2 illustrates the position of the elements of hinge means 17 when upper and middle sections 11 and 12 are aligned when the cane is to be placed in use. Hinge means 17 comprises generally first and second hinge links 21 and 22, respectively, hingedly connected together by means of hinge pin 19. Hinge link 21 has a cylindrical extension 23 adapted to be tightly received within the bore of upper cane section 11. And the second hinge link 22 is connected to middle cane section 12 by means of a cylindrical protuberance tightly received within the bore of section 12. First hinge link 21 is preferably provided at its distal, or lower, end with a pair of laterally extending ears 25 which comprise means for engaging and carrying hinge pin 19. Connection of second hinge link 22 to hinge pin 19 is accomplished by an interdigitating ear 26 projecting laterally from hinge link 22. It will be noted that ear 26 is spaced from the distal end of link 22 and projects between ears 25 on hinge link 21.

To impart additional strength to hinge means 17 when the cane is unfolded for use, the distal, or upper, region of second hinge link 22, which portion is indicated generally by reference numeral 27, extends past hinge pin 19 and is adapted to mate with a corresponding recessed or cut away region 28 on first hinge link 21. In addition, a protuberance 29 on distal region 27 of link 22 is positioned to enter a recess 30 in the adjoining region 28 of hinge link 21 to interlink the hinge links 21 and 22 and further reduce the opportunity for these links to be displaced laterally or twisted out of alignment with one another when the cane is in use.

Figure 3:
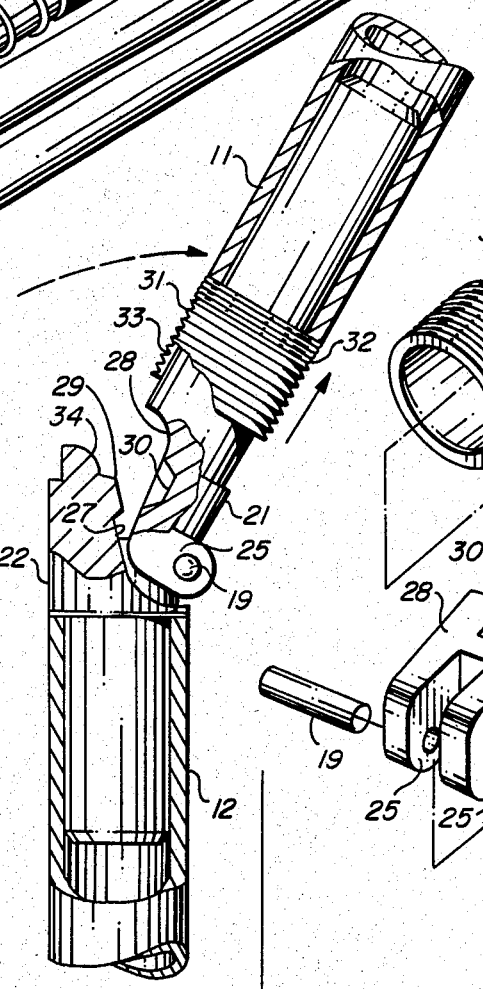
FIG. 3 is a view similar to FIG. 2 but illustrating the hinge means being opened to fold sections of the cane.
Figure 4:
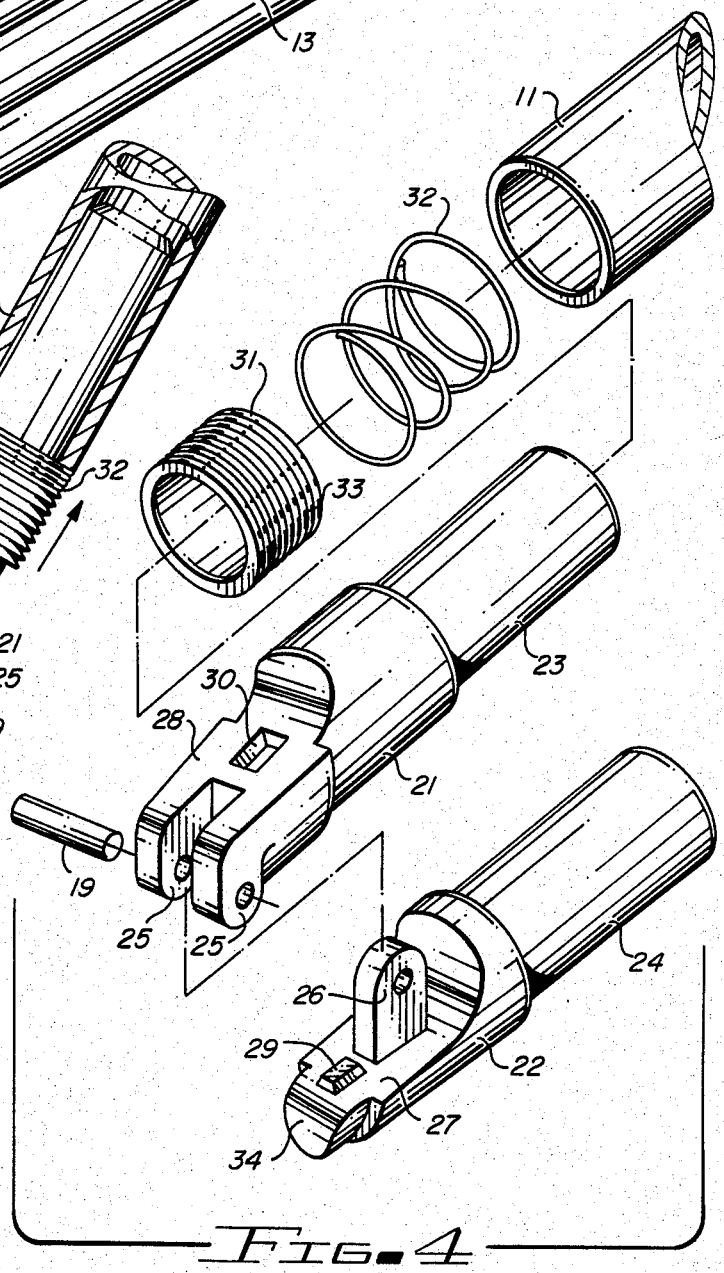
FIG. 4 is an exploded perspective view of the components of the hinge means utilized in the invention.

Hinge links 21 and 22 of hinge means 17 are securely locked in their aligned positions wherein the cane sections 11 and 12 secured thereto are aligned by means of a locking sleeve 31 carried on first hinge link 21 for sliding movement along a portion of the link. Locking sleeve 31 when in its locked position shown in FIG. 2 encircles the distal region 27 of hinge link 22 as well as an intermediate portion of hinge link 21, securely fastening these portions of the hinge links together and preventing the hinge means from opening. A helical spring 32 carried by hinge link 21 urges locking sleeve 31 toward this locked position. To release hinge means 17 locking sleeve 31 is gripped and moved axially along hinge link 21 to free the distal region 27 of hinge link 22 from hinge link 21. If desired, the outer surface of the locking sleeve 31 may be serrated as indicated at 33 to facilitate it being gripped by the fingers of the user to effect release of the hinge means 17. FIG. 3 illustrates the unlocking action of locking sleeve 31 to permit the cane sections 11 and 12 to be folded together for storage.

Hinge means 18 connecting the middle and lower sections 12 and 13 of the cane is identical to hinge means 17 described above and no further detailed description thereof is deemed to be necessary. As mentioned previously, the disposition of hinge pin 20 of hinge means 18 is to the side opposite the hinge pin 19 of hinge means 17, but the construction of the two hinge means are the same. Hinge links 21 and 22 are preferably molded from high strength, lightweight plastic material and hinge pin 19 is preferably made from metal.

A further feature of hinge means 17 which greatly facilitates erection of the cane by persons who lack manual dexterity is the automatic locking of the hinge links 21 and 22 as they are brought into alignment and sections of the cane are aligned. This feature is provided by cam surface 34 provided at the distal end of hinge link 22 and positioned to engage the cylindrical end surface of locking sleeve 31 as the hinge links are brought into alignment. Cam surface 34 moves locking sleeve 31 upwardly against the action of spring 32 until the components of the first and second hinge links come into alignment and the locking ring snaps over this distal portion of the second hinge link 22 securely locking the links together. All of this action takes place without the necessity for the person erecting the cane to move the locking sleeve.

From the foregoing it should be apparent that this invention enables a foldable cane to be reduced to a highly compact, easily stored condition and returned to a useable condition almost effortlessly by the user. The novel hinge means 17 and 18 employed in the invention constitute sturdy connections for the cane sections 11, 12 and 13 to resist unintentional collapsing of the cane. Moreover, the design of the hinge means is such that they blend with the cane sections and present a trim and elegant appearance.

What is claimed is:

1. A lockable hinge mechanism for connecting axially aligned tubular sections and permitting one section to be swung along side of the other section, a first hinge link carried by one of said tubular sections and having means for retaining a hinge pin at the distal end thereof and laterally displaced from the axis of the link, a hinge pin in said retaining means, a second hinge link carried by the other tubular section and having means spaced from the distal end thereof engaging said hinge pin, said first hinge link having a portion thereof on the side opposite said hinge pin retaining means cut away to receive a matching distal extension of said second hinge link, a locking sleeve slidably carried by said first hinge link and movable to a position in which a portion of the sleeve encompases said first hinge link and a portion of the distal extension of said second hinge link for locking said links in axial alignment, said locking sleeve being movable along said first hinge link to release said second hinge link, spring means urging said locking sleeve in position to lock said links, said second hinge link having a cam surface on the distal end thereof for engaging and moving said locking sleeve out of locking position as said hinge links are brought into alignment, shoulder means on said first hinge link for limiting movement of said locking sleeve under the urging of said spring when the links are out of axial alignment to position the sleeve for engagement by the cam surface on the second hinge link when the links are brought into alignment, and interlinking means associated with the distal extension of said second hinge link and with said cut away portion of said first link to further reduce the opportunity for the links to be displaced laterally or twisted out of alignment by external forces when the links are in axial alignment.

2. A foldable cane incorporating the hinge mechanism of claim 1.

* * * * *